US008891339B2

(12) United States Patent
Kaelin et al.

(10) Patent No.: US 8,891,339 B2
(45) Date of Patent: Nov. 18, 2014

(54) TIMEPIECE MOVEMENT OF REDUCED HEIGHT WITH A LARGE POWER RESERVE

(75) Inventors: Laurent Kaelin, Sonvilier (CH); Julien Moulin, Volleges (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 86 days.

(21) Appl. No.: 13/586,400

(22) Filed: Aug. 15, 2012

(65) Prior Publication Data

US 2013/0064047 A1 Mar. 14, 2013

(30) Foreign Application Priority Data

Aug. 17, 2011 (EP) ..... 11177840

(51) Int. Cl.

| | |
|---|---|
| ***G04B 1/10*** | (2006.01) |
| ***G04B 19/02*** | (2006.01) |
| ***G04B 33/06*** | (2006.01) |
| ***G04B 33/12*** | (2006.01) |

(52) U.S. Cl.

CPC ..... *G04B 33/06* (2013.01); *G04B 33/12* (2013.01)

USPC ..... 368/220; 368/140

(58) Field of Classification Search

USPC ..... 368/140, 145–147, 220, 228

See application file for complete search history.

(56) References Cited

U.S. PATENT DOCUMENTS

| | | | | |
|---|---|---|---|---|
| 3,041,818 | A * | 7/1962 | Jensen | 368/164 |
| 3,290,875 | A * | 12/1966 | Egger et al. | 368/220 |
| 4,408,898 | A * | 10/1983 | Vuilleumier et al. | 368/220 |
| 5,155,712 | A * | 10/1992 | Mose et al. | 368/190 |
| 7,821,877 | B2 * | 10/2010 | Sakamaki et al. | 368/80 |
| 8,274,864 | B2 * | 9/2012 | Ono | 368/220 |
| 2012/0057434 | A1 * | 3/2012 | Rudaz | 368/28 |

FOREIGN PATENT DOCUMENTS

| | | |
|---|---|---|
| CH | 14 525 | 5/1897 |
| CH | 51 982 | 6/1910 |
| CH | 54 708 | 1/1911 |
| FR | 1 181 584 | 6/1959 |

OTHER PUBLICATIONS

European Search Report issued Feb. 17, 2012 in corresponding European Application No. 11 17 7840 filed Aug. 17, 2011 (with an English Translation).

* cited by examiner

*Primary Examiner* — Sean Kayes

(74) *Attorney, Agent, or Firm* — Oblon, Spivak, McClelland, Maier & Neustadt, L.L.P.

(57) ABSTRACT

Timepiece gear train device (1) of reduced height with a large power reserve, driving display means (4) including a cannon-pinion (5) and an hour wheel (6), which are driven about a main pivot axis (AP), secant to a barrel (3), by a motion work (7) and including a driving wheel (8), which pivots about a secondary pivot axis (AS) external to said barrel (3) and is friction coupled to said motion work (7) on a friction surface (9) coaxial to said secondary pivot axis (AS).

Said driving wheel (8) includes a driving cannon pinion (83) pivoting about a wheel body (80) along said secondary pivot axis (AS) and coupled by a friction spring (84) to a shoulder (85) of said wheel body (80) forming said friction surface (9), said driving cannon-pinion (83) cooperating with a minute wheel (14) pivoting about a minute axis (AM).

20 Claims, 12 Drawing Sheets

TIMEPIECE MOVEMENT OF REDUCED HEIGHT WITH A LARGE POWER RESERVE

This application claims priority from European Patent Application No. 11177840.3 filed Aug. 17, 2011, the entire disclosure of which is incorporated herein by reference.

FIELD OF THE INVENTION

The invention concerns a timepiece gear train device of reduced height with a large power reserve, comprising at least one means of energy storage arranged to be powered by a motion imparted to a winding stem and/or an oscillating weight, said energy storage means including at least one barrel, and said gear train device driving display means which include at least one cannon-pinion and an hour wheel directly driven about a main pivot axis by a motion work, said gear train device including, driven directly or indirectly by said at least one barrel, at least one driving wheel pivoting about a secondary pivot axis external to said at least one barrel, and said driving wheel being friction coupled to said motion work on a friction surface coaxial to said secondary pivot axis of said driving wheel, and said main pivot axis being secant to said at least one barrel.

The invention also concerns a gear train module comprising at least one gear train device of this type provided with a plate of this type.

The invention also concerns a timepiece movement including at least one gear train device of this type and/or at least one gear train module of this type.

The invention further concerns a timepiece including at least one timepiece movement of this type and/or at least one gear train device of this type and/or at least one gear train module of this type.

The invention concerns the field of horology, and more specifically the field of portable timepieces, such as wristwatches, pocket watches, or pendant watches.

BACKGROUND OF THE INVENTION

The pursuit of flat movements is a constant preoccupation of the horological industry. This is in response to a permanent market demand. The object is also to be able to house mechanisms relating to different complications or functions more easily, and/or in a larger number, within the same timepiece, while retaining control of the overall thickness of the timepiece.

In a conventional mechanical movement, the energy stored in the barrel is generally transmitted to a centre-wheel. This centre-wheel meshes with a third wheel pinion. The third-wheel pinion has a dual function. On the one hand, it drives a fourth-wheel pinion, via a third-wheel secured to the third wheel pinion. The fourth-wheel pinion is integral with a seconds wheel, which meshes with the escape pinion and thus cooperates with the escape wheel and the regulating assembly for regulating the movement. The same fourth-wheel pinion is also integral with an arbour carrying a seconds hand or meshes with an arbour of this type. The other function of the third-wheel pinion is to indirectly drive both the cannon-pinion and the associated hand, and the hour wheel and the associated hour hand.

The motion work must be able to be disconnected in order to ensure normal operation in the connected position and to set the time in the disconnected position. The disconnecting mechanism generally relies on a friction mechanism.

The mechanism for indirectly driving the minute cannon-pinion and the hour wheel generally includes a friction plate which is coaxial to the cannon-pinion.

In order to drive the minute cannon-pinion, the third wheel pinion meshes with the friction plate. The friction thereof on the cannon-pinion causes the latter to pivot.

To drive the hours, the third wheel pinion again meshes with the friction plate, and the cannon-pinion driven by said plate meshes with a minute wheel, integral with a minute pinion which meshes with the hour wheel.

This tried and tested mechanism operates well, but requires a certain amount of space, particularly due to the presence of the friction plate and a surface for holding the plate on the cannon-pinion, on the opposite side to the hands. For a wristwatch, this space requirement is on the order of 0.25 to 0.35 mm, which is significant with respect to the total thickness of the movement, which is usually several millimeters, or a millimeter in extra-flat calibres such as, for example, the "Fréderic Piguet" 21 calibre, which is 1.73 mm thick. The proportion taken up by the friction plate and its holding surface is thus large, since it may represent 5 to 25% of the total thickness of a movement.

Some decentred centre-wheel embodiments have proposed different solutions for the friction plate described above.

CH Patent 377 727 in the name of Buren Watch Company, relates to a timepiece with a decentred centre-wheel which, to overcome the problem of fluttering hands in a watch with indirect driving of the minute hand, or in a "Roskopf" watch, implements a flexible minute wheel, which is stressed and whose elasticity compensates for the fluttering of the hands. In a first version, the barrel drives a centre-wheel, on which an indented intermediate wheel is mounted, which in turn drives the minute wheel, which meshes in a conventional manner with the minute and hour cannon-pinions. The centre-wheel drives a third wheel set which meshes with a fourth wheel set, which in turn meshes with the escape pinion. To set the time, the indented intermediate wheel meshes with an intermediate set hands wheel connected to the crown arbour. In a second version suited to a "Roskopf" watch, the minute wheel is sliding friction tight directly to the barrel, and meshes in a conventional manner with the minute and hour cannon-pinions. A complementary gear train, of the centre-wheel set and third wheel set type, is necessary to drive the fourth wheel set. However, in this second version, the superposition of the wheels on the barrel does not assist in decreasing the thickness of the movement.

EP Patent No. 1 243 985 in the name of Widerrecht discloses a watch movement with a central orifice, ensuring an annular arrangement of the various functions, but to the detriment of the thickness of the movement. The hour and minute cannon-pinions are tubular and at the periphery of the central orifice. As all of the gear trains have to be housed in the remaining annular volume, a particular arrangement concerns the connection between the centre-wheel set, driven by the barrel, and the minute wheel set. The centre-pinion is engaged in the bottom plate of the watch, and includes a pivot-shank, on which the minute wheel set is mounted via its pinion, which has an indentation cooperating with the pivot-shank to provide a friction coupling. Thus, the minute wheel set rotates with the centre-wheel set, except during time-setting, when it slides over the pivot-shank due to the friction coupling. However, the diameter of the motion work is necessarily limited by the particular construction, which hinders the play in such gears.

CH Patent Application No. 14 525 A in the name of EMILE JERGER discloses a Roskopf watch which has a movement with a power reserve of eight days and a barrel of large height.

The intermediate minute wheel is placed on the axis of the first centre-pinion meshing with the barrel, and is sliding friction tight on a pipe of a wheel controlling the escape mechanism.

FR Patent No. 1 181 584 in the name of RENAUDIN discloses a mechanism with a single operating button, of parallel axis to the arbours of the movement. The toothed crown of its barrel meshes with a pinion mounted on a minute arbour, and carries a toothed wheel normally driven by the minute arbour, but which can also rotate with respect to said arbour to control the setting of the hands.

CH Patent Application No. 54 708A in the name of MAIRE-FAVRE discloses a movement with a long running time, which also includes a minute wheel fitted friction tight to a cylindrical shoulder of a wheel integral with the arbour, controlled by the barrel core toothing.

CH Patent Application No. 51 982A in the name of MARC DUBOIS discloses a decentred barrel mechanism with a barrel core carrying a wheel meshing with the going train and which controls the escape mechanism. The first wheel set of the going train includes a friction tight fitted intermediate wheel, which meshes with the intermediate set-hands wheel and with a wheel wedged on a set-hands arbour which is freely housed in the core axis and indirectly actuates the hour and minute hands.

However, these mechanisms have the drawback of juxtaposing the thickness of a barrel with that of a centre-wheel, which is not conducive to the desired reduction in thickness.

The invention proposes to allow the motion work to be uncoupled while occupying the smallest possible thickness. Reducing the space required for the transmission of motion from a gear train wheel, directly or indirectly connected to the barrel, to the cannon-pinion on the one hand and to the hour wheel on the other hand, through the motion work, immediately reduces the general space requirement of the movement.

The invention therefore concerns a timepiece gear train device of reduced height with a large power reserve, comprising at least one means of energy storage, arranged to be powered by a motion imparted to the winding stem and/or to an oscillating weight, said energy storage means comprising at least one barrel, and said gear train device driving display means which include at least one cannon-pinion and one hour wheel driven directly about a main pivot axis by a motion work, said gear train device comprising, driven directly or indirectly by said at least one barrel, at least one driving wheel pivoting about a secondary pivot axis external to said at least one barrel, and said driving wheel being friction coupled to said motion work on a friction surface coaxial to said secondary pivot axis of said driving wheel, and said main pivot axis being secant to said at least one barrel, characterized in that said driving wheel includes a driving cannon-pinion pivoting about a wheel body along said secondary pivot axis and connected to a shoulder of said wheel body which forms said friction surface by a friction means formed by a friction spring, and in that said driving cannon-pinion cooperates with a minute wheel belonging to said motion work and pivoting about a minute axis.

According to a feature of the invention, said gear train device includes a bottom plate carrying wheel sets comprised in said device, said bottom plate including a first surface called the dial side surface and a second surface called the gear train side surface which are opposite to each other and connected by a peripheral edge, and said main pivot axis is located in proximity to the centre of or at the centre of said bottom plate, and the diameter of said at least one barrel, which pivots about a barrel pivot axis substantially parallel to said main pivot axis and to said secondary pivot axis, which are parallel to each other, covers an area, about said barrel pivot axis, which is greater than the smallest distance between said main pivot axis and said peripheral edge.

According to a feature of the invention, said cannon-pinion and said hour wheel project from the side of said first surface and said at least one barrel is arranged on said second surface, or vice versa.

According to a feature of the invention, said cannon-pinion meshes with a plate comprised in said minute wheel, and said hour wheel meshes with a pinion integral with said plate.

According to a feature of the invention, said driving wheel is a centre-wheel which comprises, integral with each other and with a wheel body, on the one hand a pinion which is external to said at least one barrel and meshes directly or indirectly with a drum toothing comprised in said at least one barrel, and on the other hand a plate meshing with a third wheel, which in turn meshes with a main seconds arbour pivoting about said main pivot axis coaxially to said cannon-pinion and to said hour wheel, in a centre tube.

According to a feature of the invention, the smallest diameter of said friction surface is greater than the largest pivoting guide diameter of said driving wheel with respect to a bottom plate comprised in said device.

The invention further concerns a gear train module comprising at least one gear train device of this type with a bottom plate of this type, and which comprises a means of interface with external means of adjusting said motion work.

According to a feature of the invention, said gear train module includes a means of interface with external means of powering said energy storage means including at least one barrel.

The invention further concerns a timepiece movement including at least one gear train device and/or at least one gear train module of this type, and which includes external means of adjusting said motion work cooperating with interface means comprised in said gear train device.

According to a feature of the invention, said timepiece movement includes external means of powering said energy storage means including at least one barrel cooperating with interface means comprised in said gear train device.

The invention also concerns a timepiece including at least one timepiece movement of this type and/or at least one gear train device of this type and/or at least one gear train module of this type, which is a watch and includes at least one barrel, whose diameter is larger than half the smallest dimension of said watch in a plane perpendicular to said main pivot axis.

The invention dispenses with the need for the known large diameter cannon-pinions of the prior art.

With the mechanism of the invention, there is no fourth wheel with a pinion plate, just a very small pinion. This small pinion preferably cooperates with an intermediate wheel, which cooperates with a small seconds wheel placed elsewhere in the movement.

The advantage is being able to position the seconds display as desired, either in a small seconds position or with the centre seconds.

The going train is taut, which ensures that play is permanently taken up in the movement. This situation should be compared to the conventional small seconds configuration which starts from the escape wheel, where the gear train is not taut, and the gear set requires the implementation of a spring, which is detrimental to efficiency.

It is one of the objects of the invention to maximise the volume of the barrel or barrels, so as to increase as much as possible the operating autonomy of the timepiece and possibly its additional high energy consuming functions, such as striking works, alarms or similar. The increase in stored energy may also allow the use, for some functions, of low yield technologies with very low production costs, which reduces the manufacturing cost of the timepiece but provides equivalent or better operating performance.

In a conventional configuration of the prior art, the seconds wheel passes through the entire thickness of the movement, and the maximum possible barrel diameter is then necessarily smaller than the smallest radius of the timepiece or watch.

The configuration according to the invention however allows the dimensions of the barrel diameter to be greater than the watch radius with a passage beyond the centre. Consequently, the thickness of the movement at the centre of the timepiece must be sized in a draconian manner in order to allow the barrel to be accommodated.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
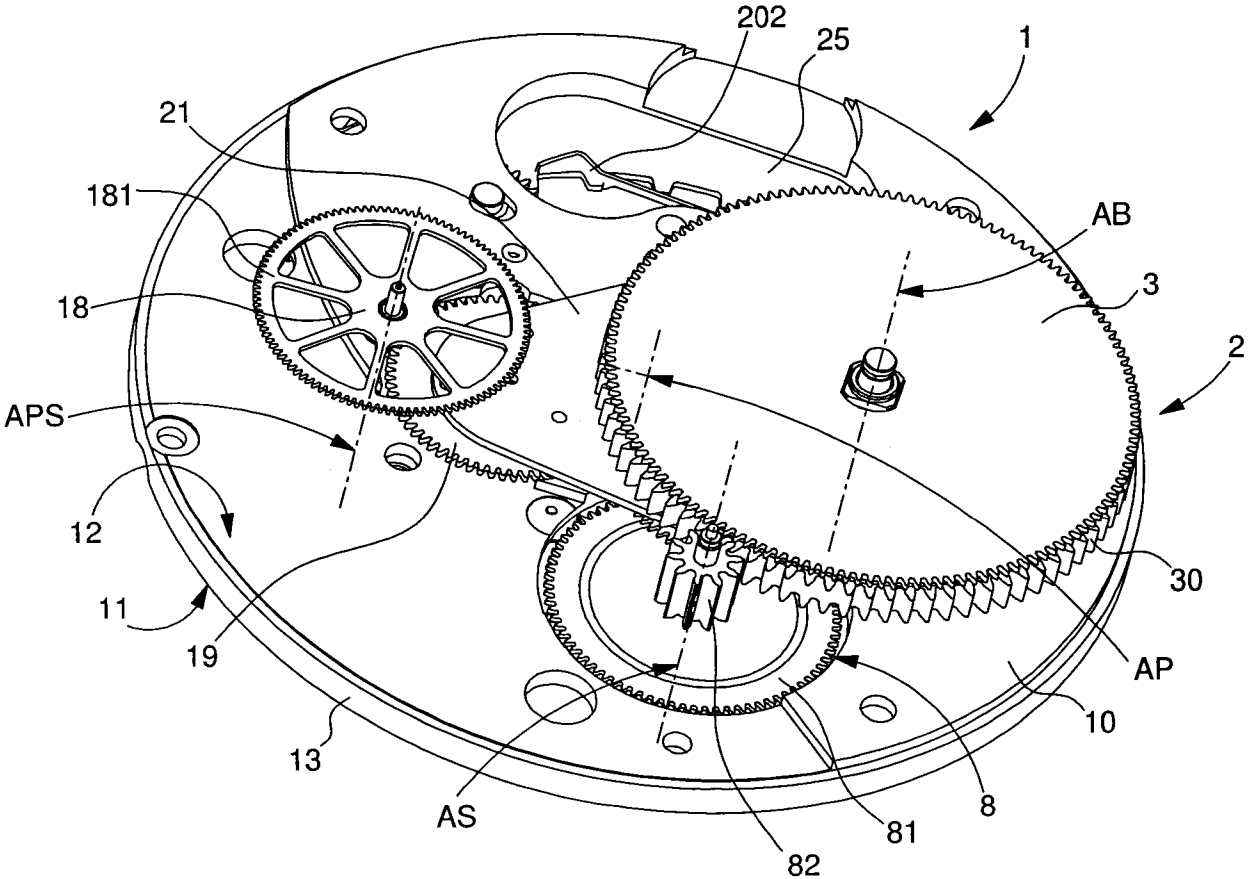
FIG. 1 shows a schematic, partial, perspective view of one part of a timepiece gear train device according to the invention, in a version comprising a bottom plate carrying the gear train wheel sets, seen from the side of a surface called the gear train side surface, which carries a barrel whose diameter is greater than the radius of said bottom plate, wherein the barrel drum meshes with a pinion of a centre-wheel, which includes a plate integral with said pinion and held on said bottom plate by a train bar, above which a decentred small seconds plate can be seen, driven by a centre-wheel connected to a main seconds arbour pivoting about a main pivot axis.

The invention concerns the field of horology, in particular portable timepieces, wristwatches, pocket watches, pendant watches or similar.

It is an object of the invention to create a gear train device compatible with the use of a very large barrel, so as to ensure a large power reserve, which is greatly improved compared to ordinary movements.

For a cylindrical barrel, volume is proportional to thickness and to the square of the diameter. In order to have maximum volume, and thus a large power reserve, it is advantageous to work with diameter rather than thickness. The invention therefore creates a mechanism that allows the barrel, or barrels if there are several, to have the largest possible diameter, which is compatible with housing other components of the movement. Choosing a large barrel diameter also means that the thickness of the barrel is reduced, and therefore the thickness of the movement and that of the watch, while providing a power reserve that is considerably greater than in the prior art.

In particular, the invention creates conditions which permit use of a barrel whose diameter is much larger than the radius of the watch, and thus which covers the position of the main pivot axis which is usually centred on the watch.

Another concern is to ensure compact height and reduced production costs, which can be achieved by a reduced number of very simple components and by a design devised for automated paraxial assembly.

Thus, the invention concerns a timepiece gear train device 1, of reduced height and with a large power reserve. This device 1 includes at least one means of energy storage 2, arranged to be powered by a motion imparted to a winding stem and/or an oscillating weight. This energy storage means 2 includes at least one barrel 3.

Gear train device 1 drives display means 4, which include at least one minute cannon-pinion 5, hereinafter simply "cannon-pinion 5", and an hour wheel 6, driven directly about a main pivot axis AP by a motion work 7.

According to the invention, gear train device 1 includes, directly or indirectly driven by said at least one barrel 3, at least one driving wheel 8 pivoting about a secondary pivot axis AS, which is external to said barrel 3.

This driving wheel 8 is friction coupled to motion work 7 on a friction surface 9 coaxial to said secondary pivot axis AS, by disconnectable friction coupling means, particularly when the time is set by regulating means of the motion work, which may be external or internal to gear train device 1.

According to the invention, the projected extension of main pivot axis AP is secant to barrel 3, i.e. the area covered by barrel 3 is larger than in prior art movements, since it greatly exceeds the central main pivot axis.

The invention endeavours to arrange the gear train underneath the barrel, ensuring that the axes do not pass through the mechanism and, more generally, the movement 200 which can incorporate device 1.

Therefore, the wheel sets which pivot about main pivot axis AP are mounted to project unilaterally relative to a bottom plate 10 on which they are mounted in a cantilever arrangement. In a preferred embodiment, illustrated in the Figures, this gear train device 1 includes a bottom plate 10 of this type carrying wheel sets comprised in said device 1. Said bottom plate 10 has a first dial side surface 11 and a second train side surface 12, which are opposite each other and connected by a peripheral edge 13.

Main pivot axis AP is preferably located in proximity to the centre or at the centre of bottom plate 10. The diameter of barrel 3, which pivots about said barrel pivot axis AB, substantially parallel to main pivot axis AP and to secondary pivot axis AS, which are parallel to each other, covers an area which is greater than the smallest distance between main pivot axis AP and peripheral edge 13.

Preferably, the drum of barrel 3 passes above main pivot axis AP.

To free the central area in proximity to main pivot axis AP, all of the wheel sets whose pivot axis is in proximity to pivot axis AP are preferably mounted to project from one side with respect to bottom plate 10, if possible pivotably mounted on studs driven into the bottom plate, or otherwise with a short guide element in said plate. Cannon pinion 5, hour wheel 6 and motion work 7 are thus mounted so that the central volume of the mechanism is free to house the barrel drum, or barrel drums if there are several.

Advantageously, driving wheel 8 is a centre-wheel which includes, integral with each other and with a wheel body 80, on the one hand a pinion 82 external to barrel 3 and directly or indirectly meshing with a drum toothing 30 comprised in barrel 3, and on the other hand a plate 81 meshing with a third wheel 15, which in turn meshes with a main seconds arbour 16. The main seconds arbour pivots about the main pivot axis AP coaxially to cannon pinion 5 and to hour wheel 6, in a centre tube 17.

FIG. 1 shows said bottom plate 10 carrying the wheel sets of said train 1, seen from the second, train side surface 12. The diameter of barrel 3 is greater than the radius of bottom plate 10. The drum of said barrel has a drum toothing 30, which meshes with a pinion 82 of a centre-wheel 8, which includes a plate 81 integral with said pinion 82 and held on said bottom plate 10 by a train bar 21, above which there is seen a plate 181 of a decentred small seconds wheel 18.

Figure 2:
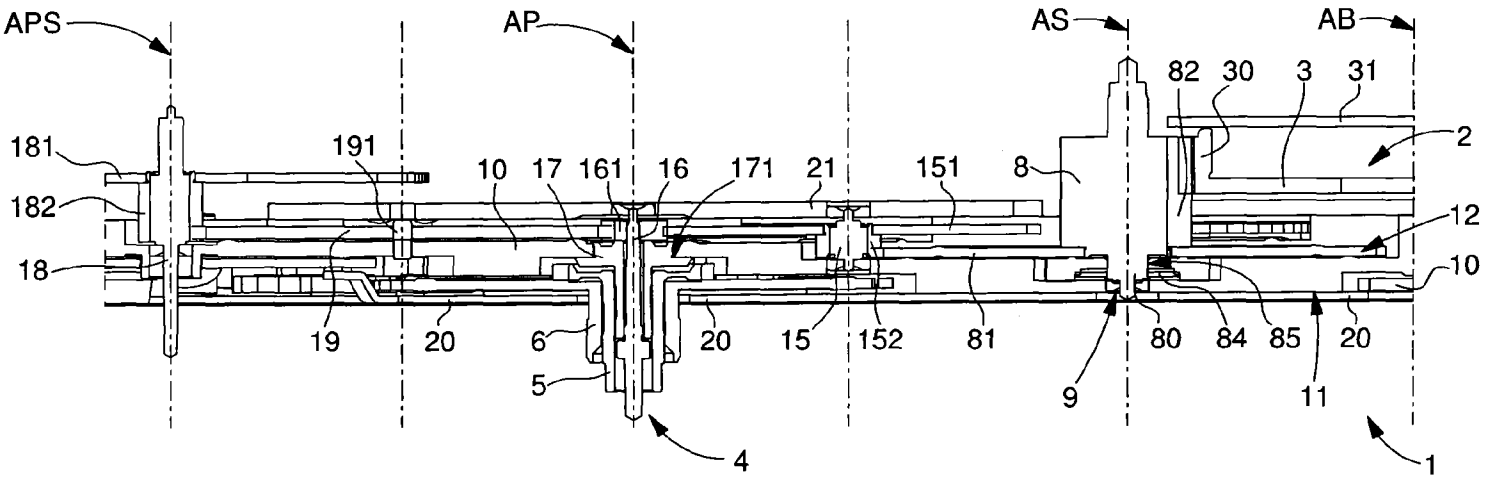
FIG. 2 shows a schematic, partial broken cross-section through the axes of certain wheel sets of the gear train device according to the invention, said wheel sets being the small seconds of FIG. 1, an intermediate third wheel, a minute cannon-pinion and an hour wheel coaxial about a centre tube defining a main pivot axis and in which a main seconds arbour pivots, a third wheel inserted between said main seconds arbour and the centre-wheel of FIG. 1, and said same centre-wheel meshing with a barrel drum toothing.

Preferably, as seen in FIG. 2, cannon-pinion 5 and hour wheel 6 project from the side of first surface 11, while barrel 3 is arranged on second surface 12, or vice versa.

The disconnectable friction coupling means on driving wheel 8 includes a driving cannon-pinion 83 pivoting about a wheel body 80 along secondary pivot axis AS. This driving cannon-pinion 83 is connected to a shoulder 85 of wheel body 80. This shoulder 85 forms the friction surface 9, which cooperates with friction means formed by a friction spring 84.

Driving cannon-pinion 83 cooperates with a minute wheel 14 which belongs to motion work 7 and which pivots about a minute axis AM.

Moreover, cannon-pinion 5 meshes in a conventional manner with a plate 141 comprised in minute wheel 14 and which hour wheel 6 meshes with a pinion 142 integral with said plate 141.

Figure 4:
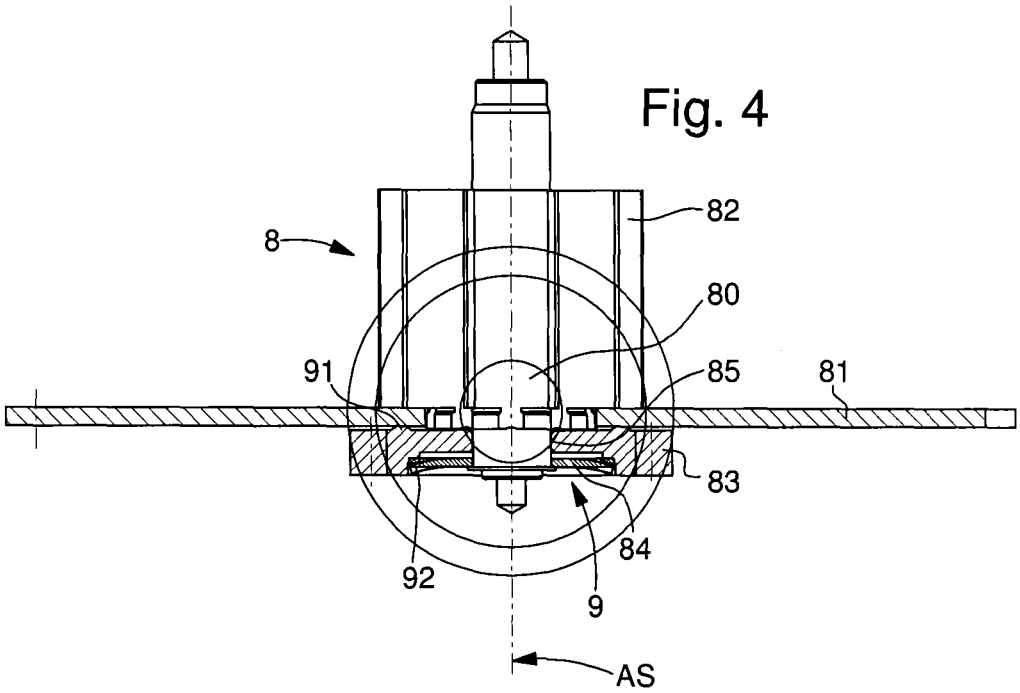
FIG. 4 shows a schematic cross-section passing through the pivot axis of the centre-wheel of FIG. 1 showing the detail of the cannon-pinion and friction thereof.
Figure 5:
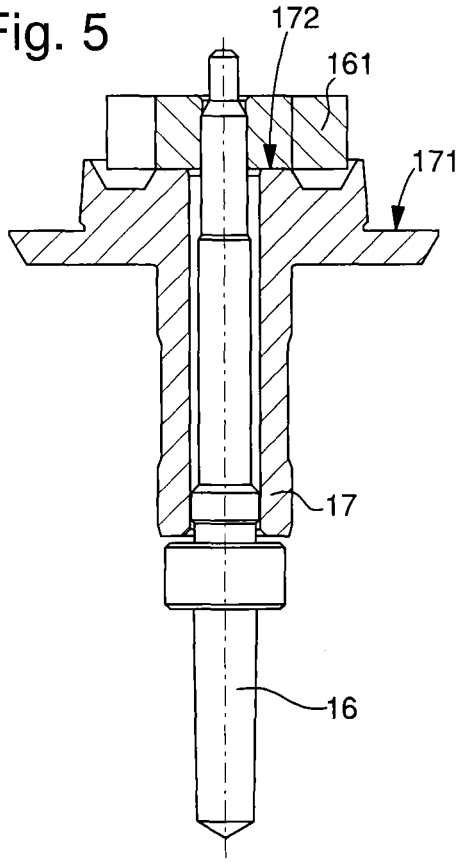
FIG. 5 shows a schematic cross-section passing through the pivot axis of the main seconds arbour of FIG. 2 guided in the centre tube, which is shouldered and abutting thereon.
Figure 6:
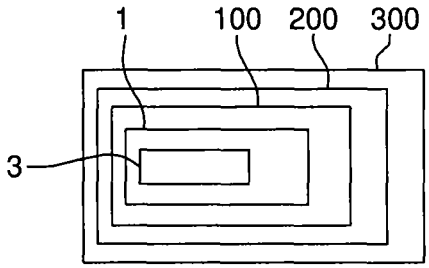
FIG. 6 shows, in the form of block diagrams, a timepiece comprising a movement which includes a gear train module in turn comprising a gear train device according to the invention, carrying a barrel.

As seen in FIG. 4, friction surface 9 preferably comprises at least: on the one hand, a first friction surface 91 between driving cannon-pinion 83 and plate 81 and on the other hand, a second friction surface 92 between friction spring 84 and shoulder 85.

Advantageously, owing to the gear train arrangement of the invention, gear train device 1 includes a small seconds wheel 18, which pivots about a small seconds axis APS and which meshes, via a pinion 182 comprised therein and via at least one intermediate wheel 19, with a pinion 161 comprised in a main seconds arbour 16. Said main seconds arbour 16 pivots about the main pivot axis AP coaxially to cannon-pinion 5 and to hour wheel 6, in a centre tube 17.

This centre tube 17 is mounted in abutment, via a shoulder 171 comprised therein, on a bottom plate 10 comprised in device 1, on the first dial side surface 11. When main seconds arbour 16 is mounted, this shoulder 171 allows the stress to be transferred onto centre tube 17 and then plate 10.

As seen in the Figures, cannon-pinion 5 and hour wheel 6 are coaxially mounted, and preferably in a cantilever arrangement, guided axially on each other and on centre tube 17, which is centred on main pivot axis AP and fixed to a bottom plate 10 comprised in device 1, on the first dial side surface 11, and they are held axially by a retaining plate 20.

Preferably, this retaining plate 20 forms or carries a complementary display dial which cooperates with display means or hands or discs or rings driven by cannon-pinion 5 and hour wheel 6 and/or by the main seconds arbour 16 and/or a small seconds wheel 18 as described above.

Advantageously, this retaining plate 20 includes elastic return means arranged to press the wheel sets comprised in device 1 onto plate 10.

Figure 3:
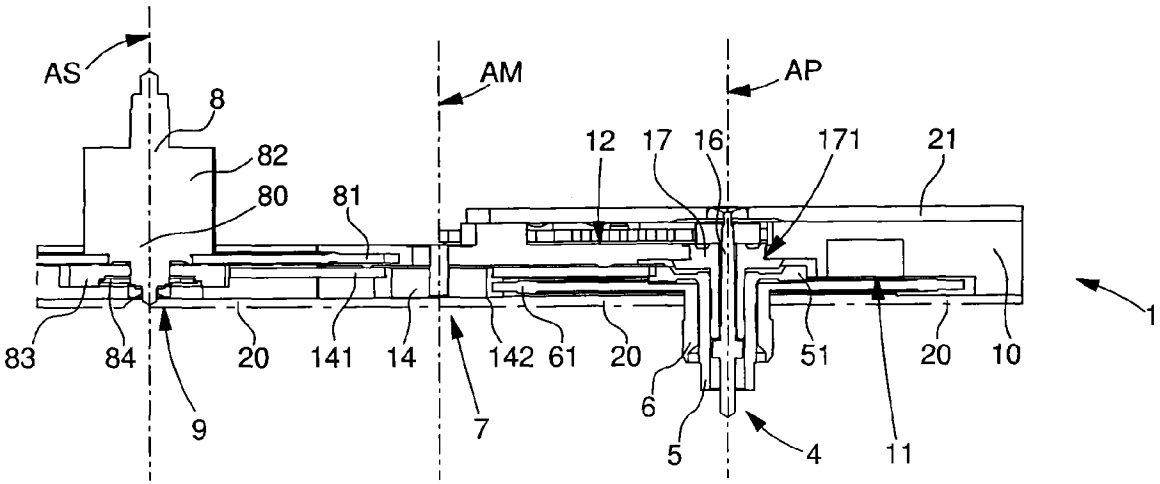
FIG. 3 shows, a schematic, partial, broken cross-section through the axes of certain wheel sets comprised in the gear train device of the invention, said wheel sets being the centre-wheel of FIG. 1 which, according to the invention, carries a cannon-pinion mounted by a friction coupling, a minute wheel which cooperates with said cannon-pinion and the coaxial minute and hour cannon-pinions of FIG. 1.

The kinematics is shown in FIGS. 2 and 3. The connections with the escape mechanism, the pallet lever and the sprung balance are not shown in the Figures and can be achieved in a conventional manner, from the small seconds wheel, which is accessible to those skilled in the art.

FIG. 2 shows the energy storage means 2, formed here by a barrel drum 3, which carries and encloses a spring (not shown) hooked at the other end to a core (not shown). A conventional ratchet 31 also acts as a cover for barrel 3. A drum toothing 30 cooperates with pinion 82 of the centre-wheel 8, the plate 81 of which meshes with a pinion 152 of a third wheel 15. Centre-wheel 8 carries driving cannon-pinion 83, via friction spring 84 which bears on shoulder 85 of centre-wheel 8. A plate 151 of third wheel 15 meshes with pinion 161 of main seconds arbour 16.

FIG. 2 also shows the direct driving of small seconds wheel 18 via the pinion 182 thereof, via intermediate wheel 19 which meshes with pinion 161. This arrangement of small seconds wheel 18 is a taut arrangement, unlike the prior art where the small seconds wheel is driven by the escape wheel and is not taut. This configuration also means that the centre seconds can be used, as desired, on the main seconds arbour 16 or small seconds wheel 18. It is clear that it is easy to arrange the small seconds wheel 18 and intermediate wheel 19 according to the space available, so as to position small seconds wheel 18 in various areas of the watch display.

FIG. 3 shows more particularly motion work 7, with minute wheel 14, a plate 141 of which meshes with the driving cannon-pinion 83 of centre-wheel 8 and which also meshes with cannon-pinion 5 on wheel 51 comprised therein. Minute pinion 142 meshes with a plate 61 of hour wheel 6.

According to the invention, friction spring 84 is a flat spring which is mounted pre-stressed via rivets. The riveting is performed from the exterior and avoids the use of a retaining washer. Choosing suitable tolerances avoids the requirement for friction adjustment.

The kinematics according to the invention means that the entire going train is mounted taut, which is advantageous since any play is automatically taken up. The slight loss of energy caused by friction by the two additional wheel sets, which are the intermediate third wheel and the fourth wheel pinion, is adequately compensated for by the gain in stored energy, because of the size of barrel 3, which is much larger than an ordinary barrel, and results in at least 20% increase in power reserve.

When the watch is working normally, the friction spring 84 couples driving cannon-pinion 83 with the wheel body 80 of centre-wheel 8, and there is a continuous kinematic chain between barrel 3 and the displays.

When the motion work is being adjusted, disconnecting the centre-wheel 8 and the barrel with which it meshes allows the displays to be adjusted.

Whenever possible, the wheel sets are pivotally mounted in a cantilever arrangement on studs. In particular, minute wheel 14 pivots on a stud 143 driven into bottom plate 10. Intermediate wheel 19 likewise pivots on a stud 191 which is also driven into bottom plate 10. In a variant which is not illustrated in the Figures, the third wheel 15 also pivots on a stud.

Figure 7:
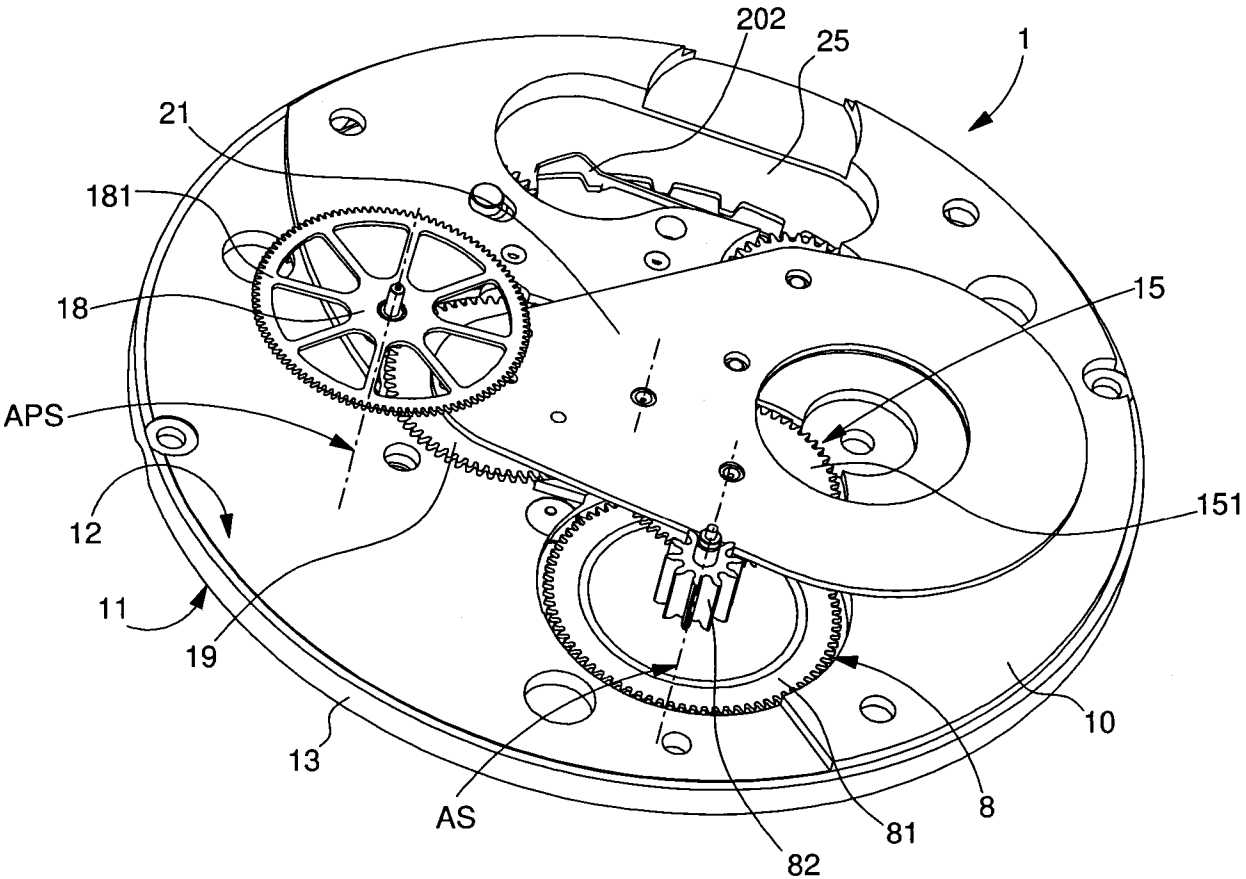
FIG. 7 shows, in a similar manner to FIG. 1, the same assembly without the barrel, with one portion of the gear train immobilised in an axial position by a gear train bar.
Figure 8:
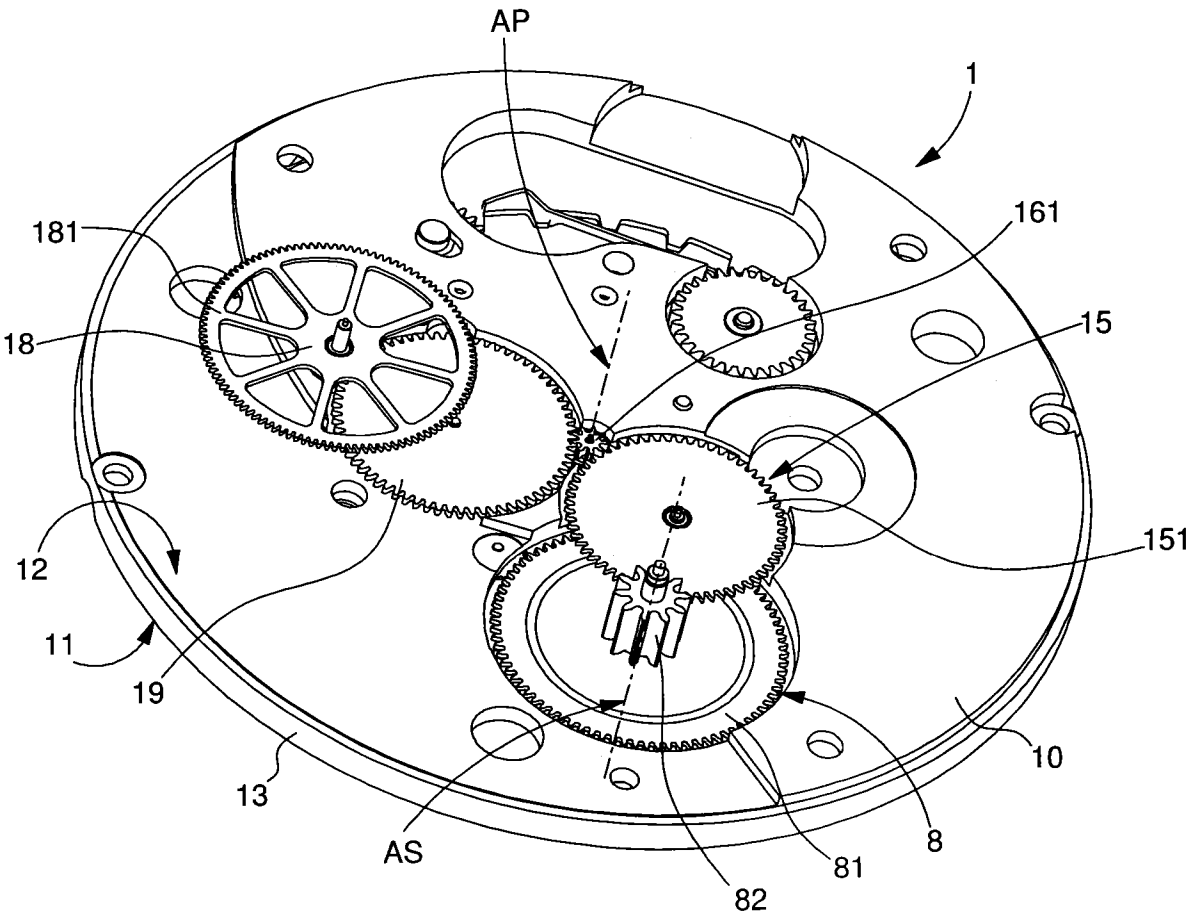
FIG. 8 shows a similar view to FIG. 7 of the same assembly without the gear train bar.

As seen in FIG. 7, one portion of the gear train is immobilised in an axial position by a train bar 21.

Figure 9:
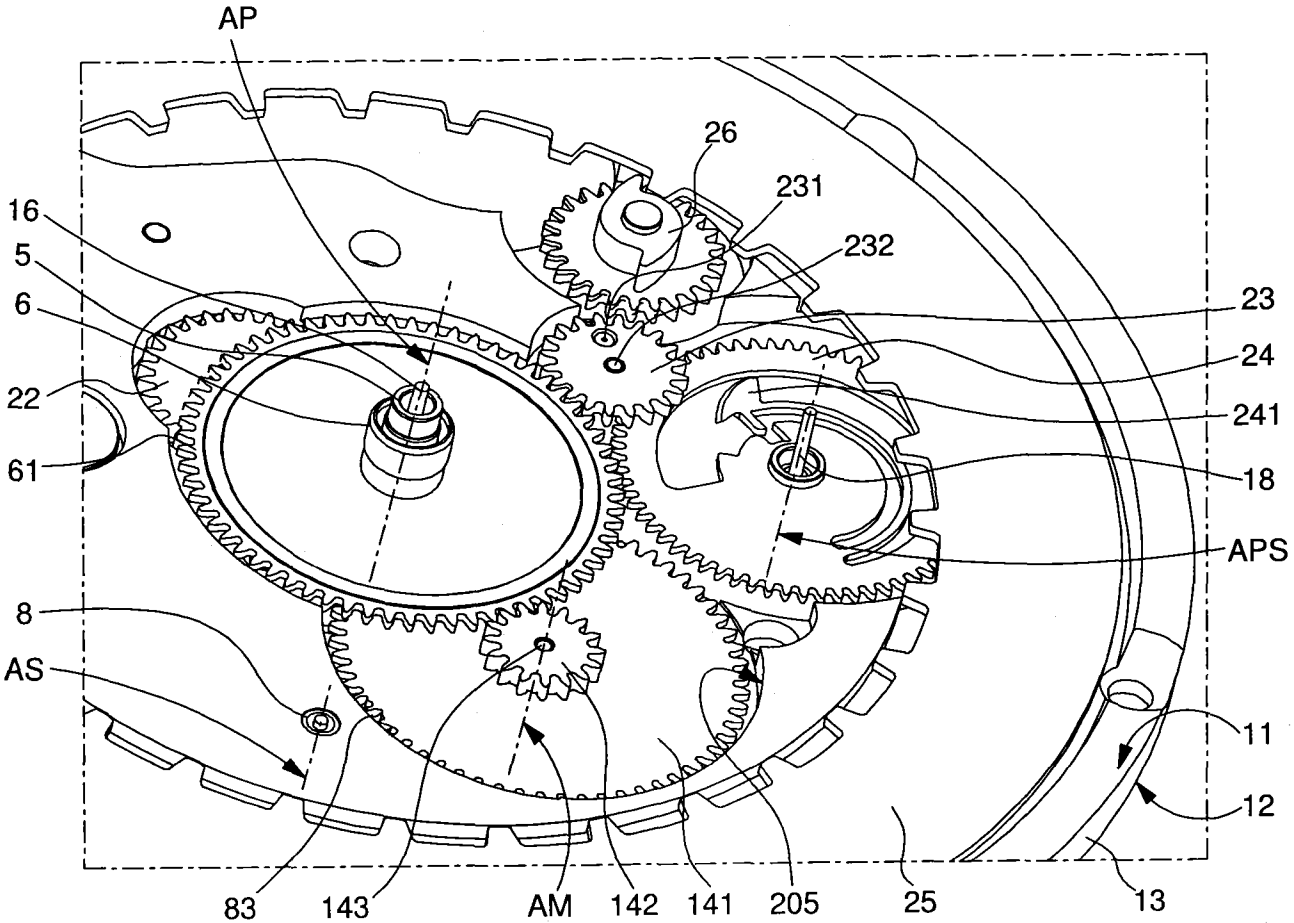
FIG. 9 shows the same assembly, in a similar manner to FIG. 1, seen from the other side of the bottom plate, from the dial side surface, with a main display train, about a main pivot axis including an hour wheel, a minute cannon-pinion, and a main seconds arbour, with the cannon-pinion cooperating with a set hands wheel. The centre-wheel, which is mounted on the opposite side of the bottom plate, cooperates, through an aperture therein, with a minute train which in turn cooperates with the main display train. One end of the small seconds wheel arbour of FIG. 1 is mounted concentrically to a date drive wheel, which cooperates with an intermediate date wheel.
Figure 10:
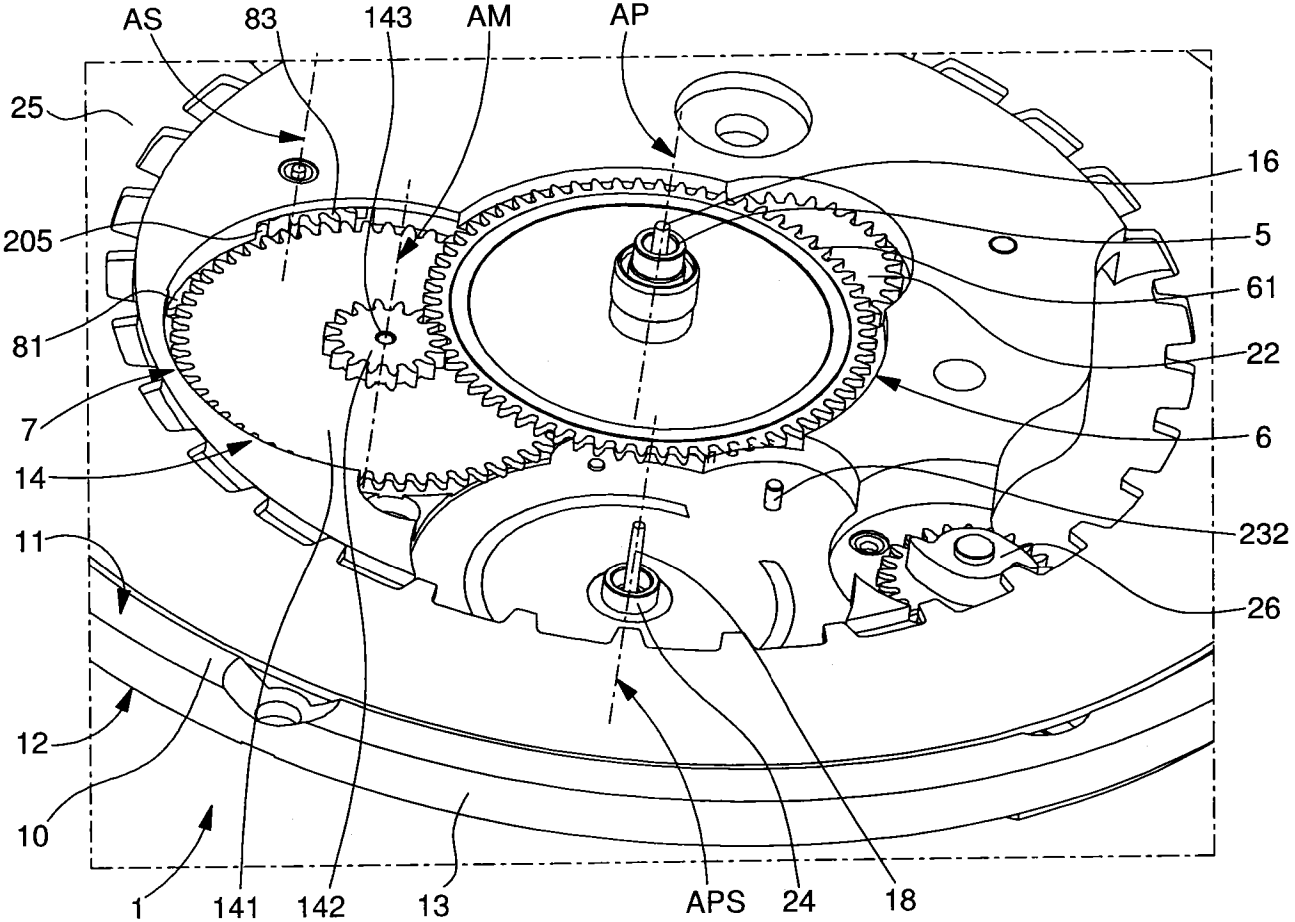
FIG. 10 shows, in a similar manner to FIG. 9, the same assembly without the date drive wheel and the intermediate date wheel.
Figure 11:
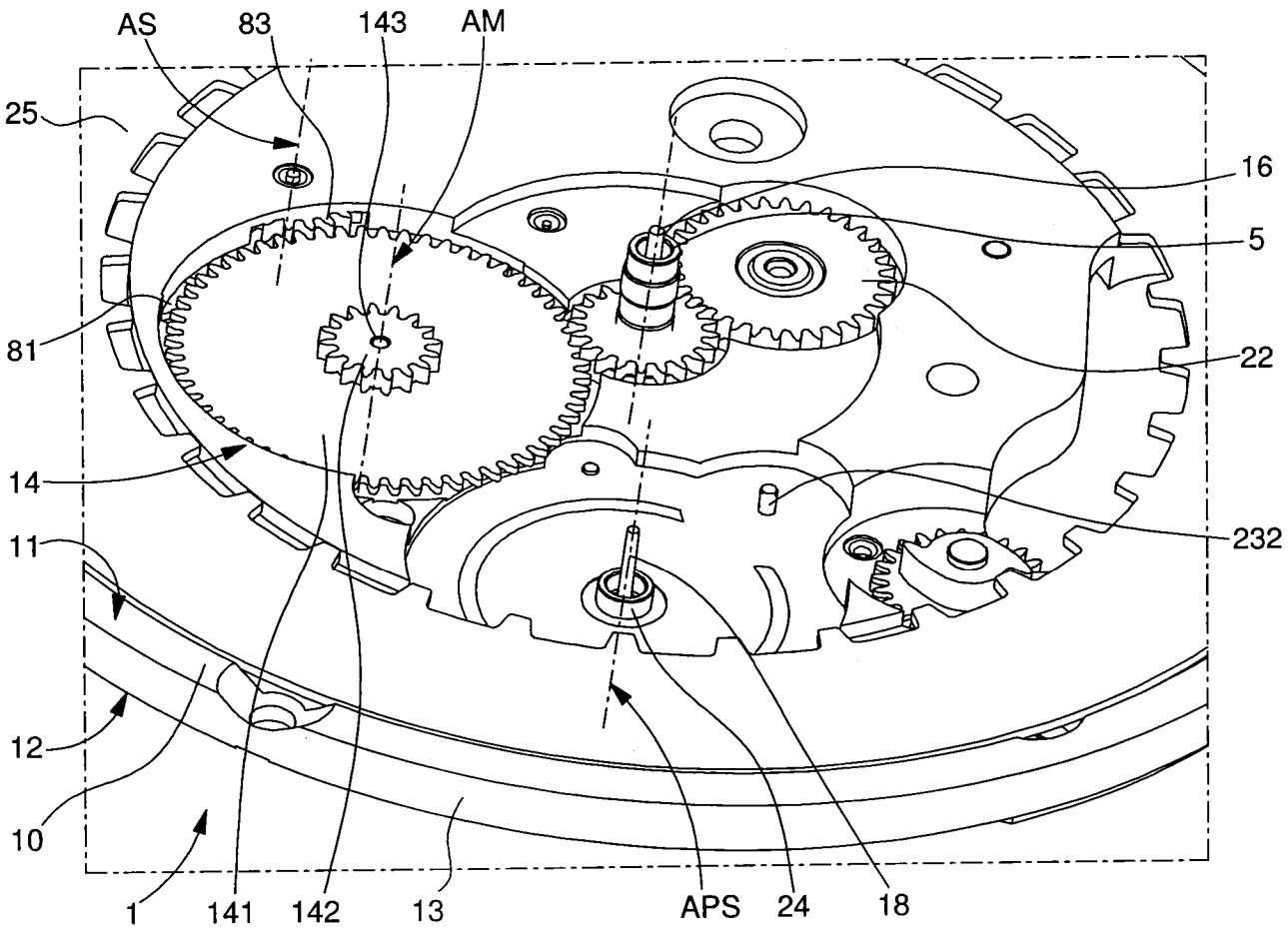
FIG. 11 shows a similar view to FIG. 10 of the same assembly without the hour wheel.

FIG. 9 shows device 1 from the first dial side surface 11, with a main display train about the main pivot axis AP, including hour wheel 6, cannon-pinion 5 and the main seconds arbour 16. Cannon-pinion 5 cooperates with a set hands wheel 22.

Centre-wheel 8, which is mounted on the opposite side 12 of plate 10, cooperates via an aperture 205 therein with minute train 14, which in turn cooperates with the main display train.

According to a feature of the invention, one end of the arbour of the small seconds wheel 18 is mounted concentrically with a date driving wheel 24, which cooperates with an intermediate date wheel 23. The latter is pivotally mounted on a stud 232 and includes an off-centre stud 231 for driving the date driving wheel 24. The latter includes a finger-spring 241 arranged to drive a date disc 25. The latter can also be driven by a date corrector 26.

Figure 12:
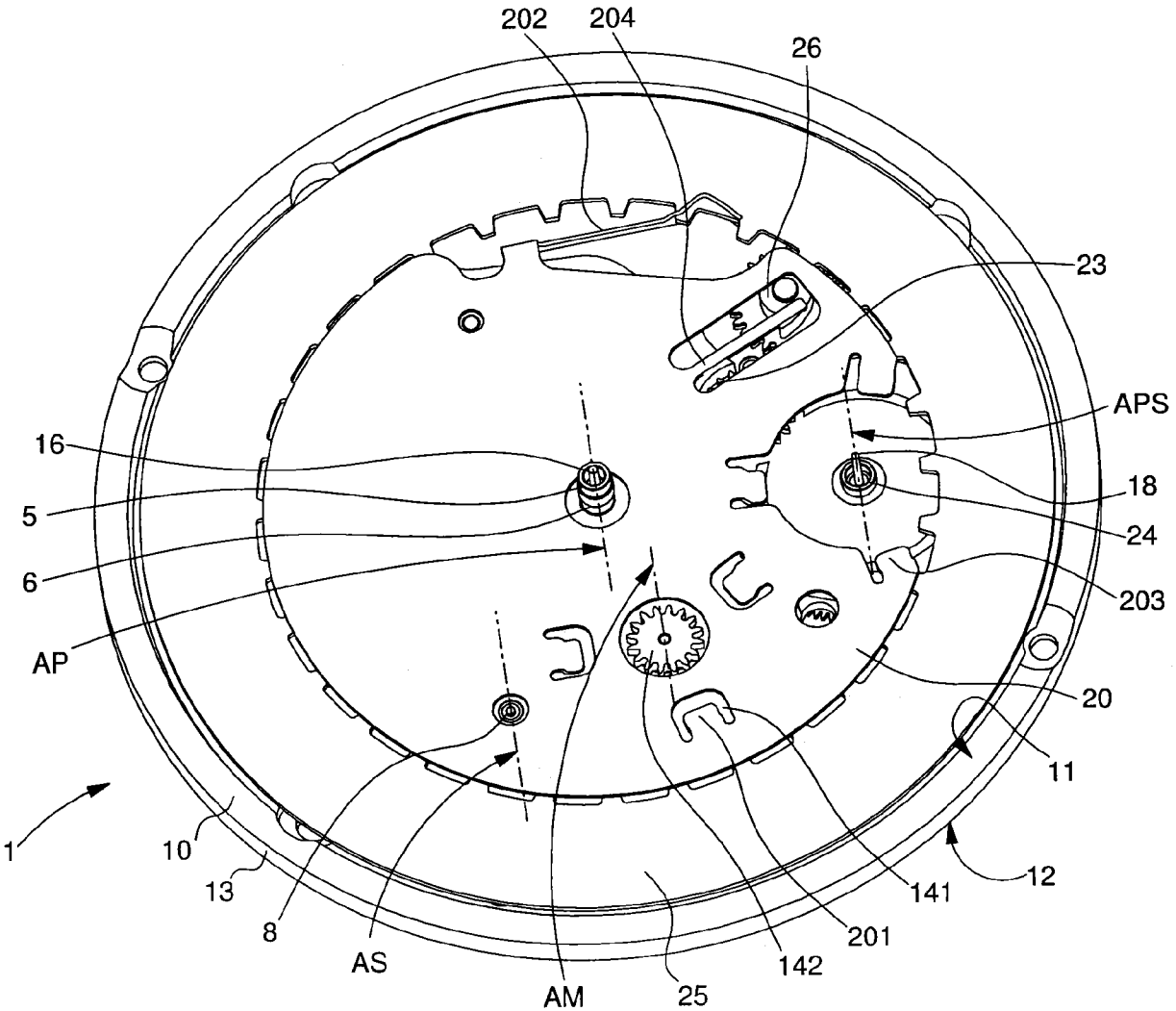
FIG. 12 shows, in a similar manner to FIG. 9, a view of the same same assembly, held by a retaining plate acting as an elastic hold device for certain wheel sets.
Figure 13:
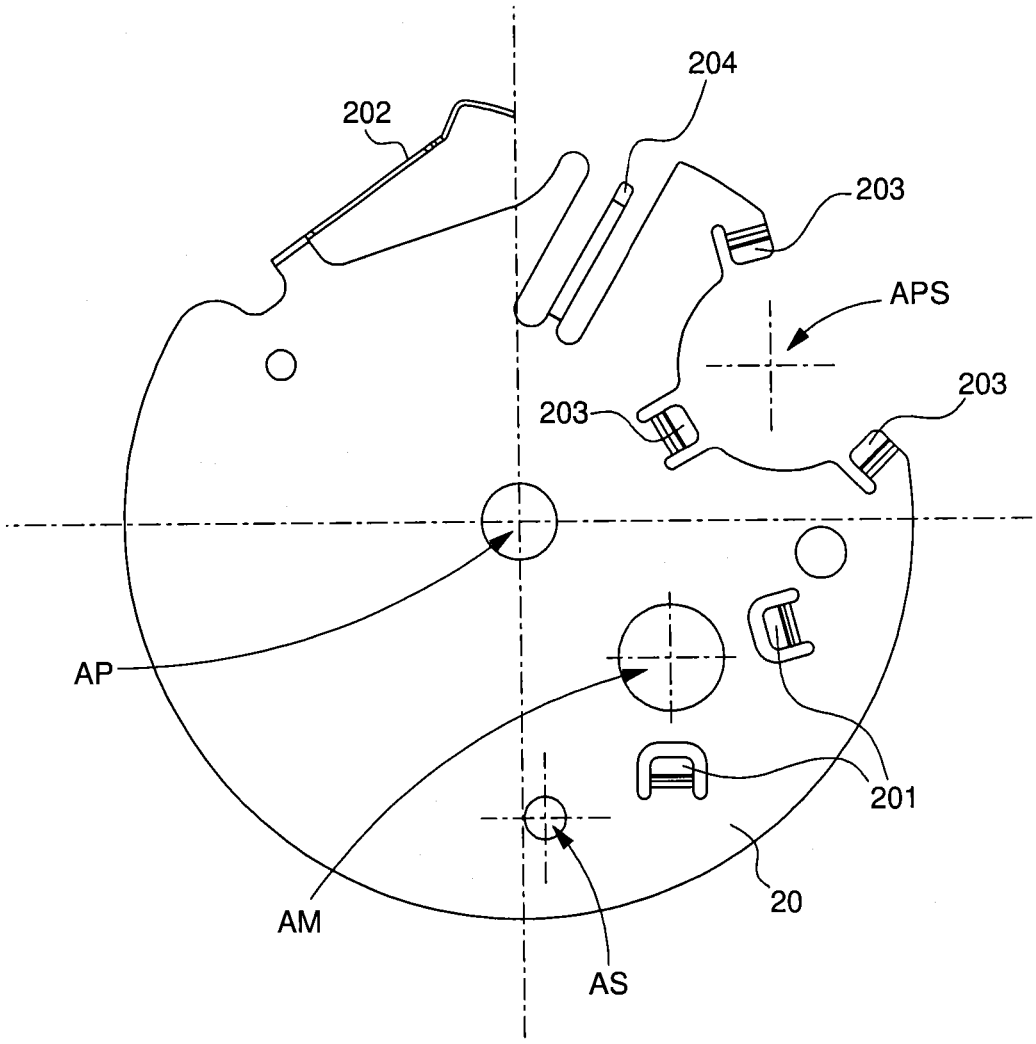
FIG. 13 shows a schematic plan view of the retaining plate of FIG. 12.
Figure 14:
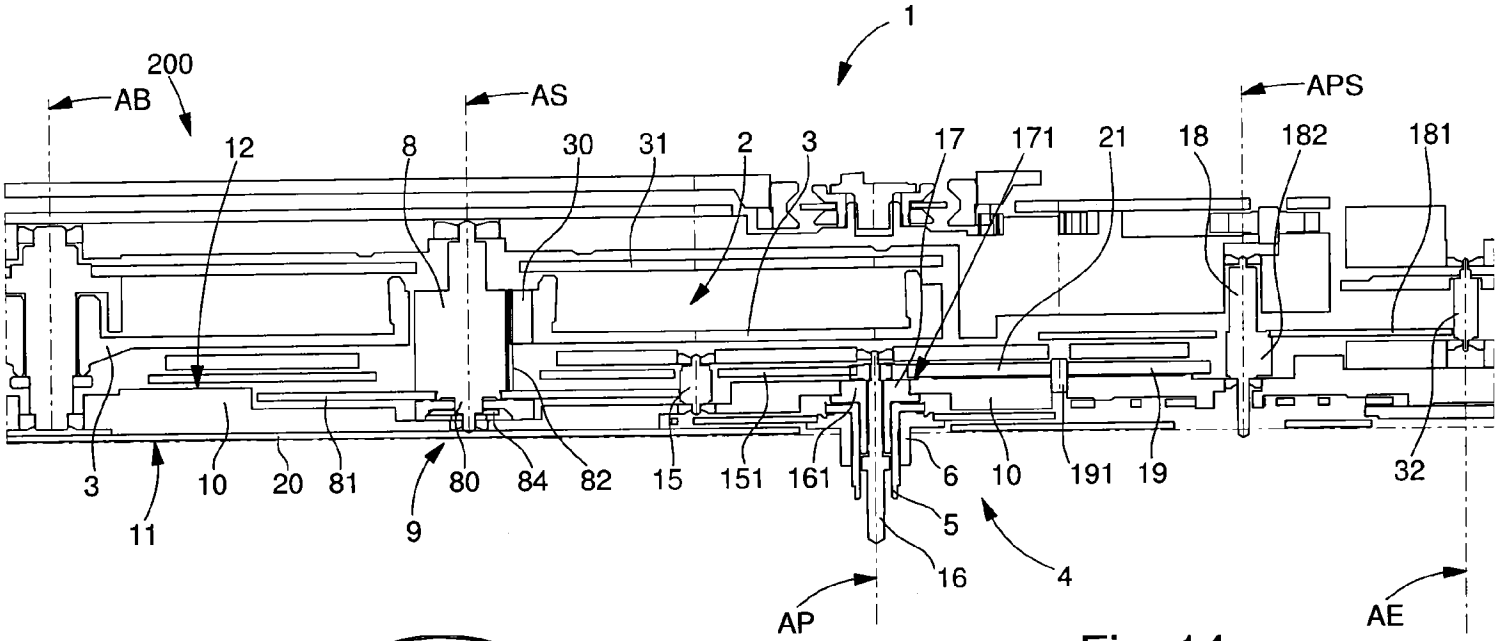
FIG. 14 shows a schematic, partial cross-section of a movement integrating a device according to the invention, along a broken cross-section illustrated in FIG. 14A, showing a front view of the movement from the gear train side.
Figure 14A:
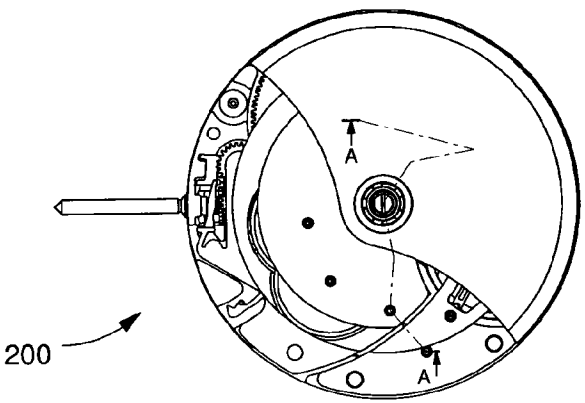
Figure 15:
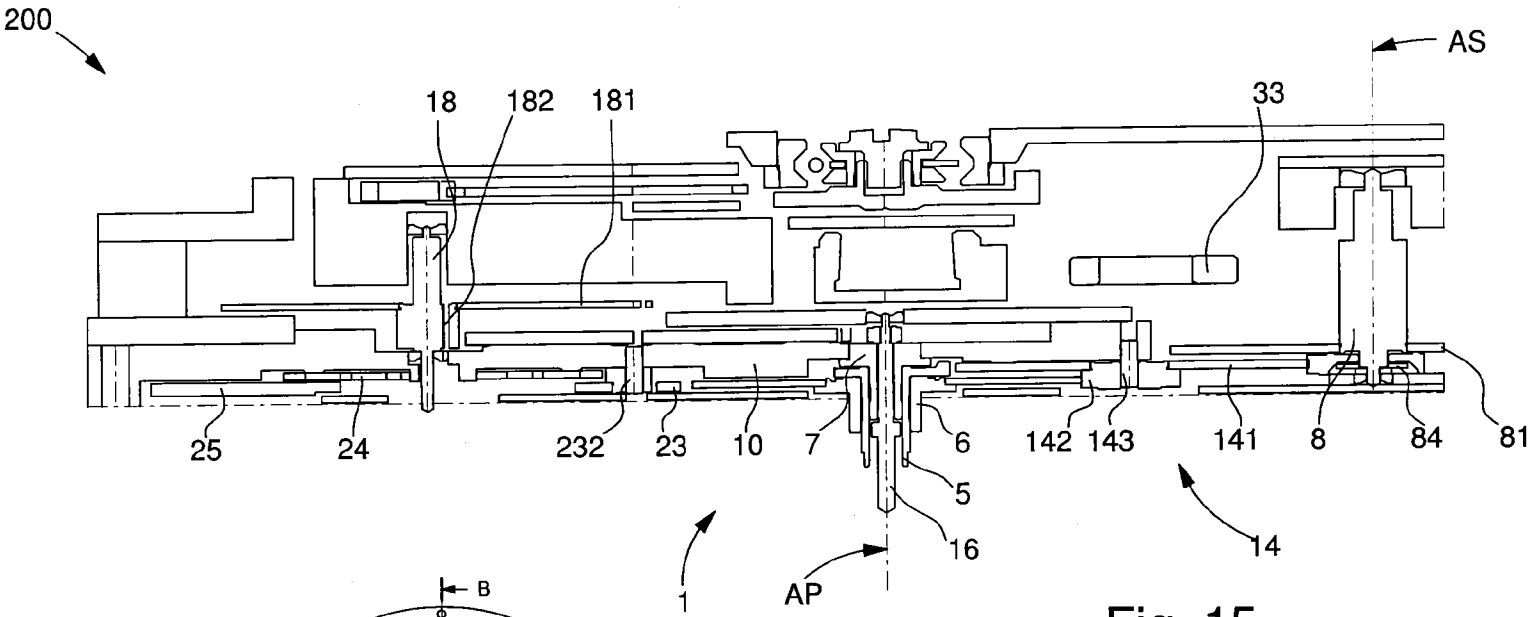
FIG. 15 shows a schematic, partial, cross-section of the movement of FIG. 14, along a broken cross-section illustrated in FIG. 15A, showing a front view of the movement from the dial side.
Figure 15A:
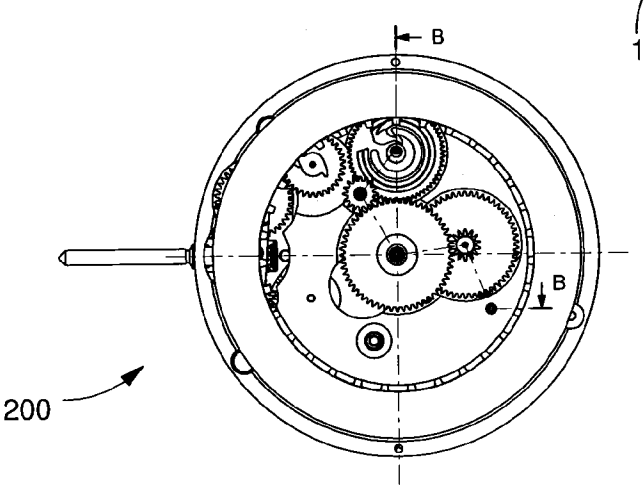

Device 1 is advantageously held, as seen in FIG. 12, by a retaining plate 20, which is seen in FIG. 13 and acts an elastic holding device for some wheel sets. In particular, this plate 20 includes finger springs 201 for holding plate 141 of minute wheel 14, a jumper spring 202 for holding date disc 25, finger springs 203 for directly or indirectly holding date driving wheel 24, and a lug spring 204 for holding date corrector 26.

The invention also concerns a gear train module 100 including at least one gear train device 1 of this type with one bottom plate 10 of this type. This module 100 preferably includes a means of interface with external means of adjusting motion work 7. In a preferred embodiment, the barrel is not part of the gear train module, but it is of course also possible for it to be integrated therein. Advantageously, gear train module 100 includes a means of interface with external means of powering energy storage means 2 including at least one barrel 3. This module 100 further includes, either an escape mechanism, a pallet lever and a sprung balance, or a means of connection with an escape mechanism controlled thereby.

The invention also concerns a timepiece movement 200 including at least one gear train device 1 and/or at least one gear train module 100 of this type.

It preferably includes external means of adjusting said motion work 7 cooperating with interface means comprised in said gear train device 1.

Advantageously, this movement 200 includes external means of powering energy storage means 2 including at least one barrel 3 cooperating with interface means comprised in gear train device 1.

FIGS. 14, 14A, 15, 15A illustrate a movement of this type. They show a barrel ratchet 31, an escape wheel 32 pivoting about an escape axis AE and a balance 33, the interactions of which are known to those skilled in the art and will not be detailed here.

The invention also concerns a timepiece 300 including at least one timepiece movement 200 of this type and/or at least one gear train device 1 of this type, and/or at least one gear train module 100 of this type. This timepiece 300 is preferably a watch, and includes at least one barrel 3 whose diameter is greater than half the smallest dimension of the watch in a plane perpendicular to main pivot axis AP.

In summary, the fact of arranging the gear train underneath the barrel and avoiding the use of an arbour passing through the movement, allows the diameter of the barrel to be enlarged and therefore the power reserve to be increased.

Compared to conventional embodiments, certain elements arranged at the centre, particularly the cannon-pinion plate and the centre-seconds plate, are no longer used. Combined with the action of increasing the diameter, this allows the barrel to be very thick.

The mechanisms according to the invention are well suited to automated paraxial assembly, since all the components are assembled from the front.

What is claimed is:

1. A timepiece gear train device with a power reserve, comprising:

at least one energy storage means arranged to be powered by a motion imparted to a winding stem and/or to an oscillating weight, said energy storage means including at least one barrel;

display means including at least one cannon-pinion and an hour wheel driven directly about a main pivot axis by a motion work; and at least one driving wheel driven directly or indirectly by said at least one barrel, said at least one driving wheel pivoting about a secondary pivot axis external to said at least one barrel, and said at least one driving wheel being friction coupled to said motion work on a friction surface coaxial to said secondary pivot axis of said at least one driving wheel, wherein said main pivot axis is secant to said at least one barrel, wherein said at least one driving wheel includes a driving cannon-pinion pivoting about a wheel body along said secondary pivot axis and connected to a shoulder of said wheel body which forms said friction surface by friction means formed by a friction spring, and wherein said driving cannon-pinion cooperates with a minute wheel belonging to said motion work and pivoting about a minute axis.

2. The timepiece gear train device according to claim 1, further comprising a bottom plate carrying wheel sets, said bottom plate including a first surface which is a dial side surface and a second surface which is a gear train side surface, said first and second surfaces being opposite to each other and connected by a peripheral edge, and wherein said main pivot axis is located in proximity to a center of or at the center of said bottom plate, and a diameter of said at least one barrel, which pivots about a barrel pivot axis substantially parallel to said main pivot axis and to said secondary pivot axis which are parallel to each other, covers an area about said barrel pivot axis, which is greater than a smallest distance between said main pivot axis and said peripheral edge.

3. The timepiece gear train device according to claim 2, wherein said cannon-pinion and said hour wheel project from a side of said first surface, and wherein said at least one barrel is arranged on said second surface or vice versa.

4. A gear train module comprising:

at least one timepiece gear train device according to claim 2; and means of interface with external means of adjusting said motion work.

5. A gear train module comprising:

at least one timepiece gear train device according to claim 2; and means of interface with external means of powering said energy storage means including said at least one barrel.

6. The timepiece gear train device according to claim 1, wherein said cannon-pinion meshes with a plate comprised in said minute wheel, and wherein said hour wheel meshes with a pinion integral with said plate.

7. The timepiece gear train device according to claim 1, wherein said at least one driving wheel is a center-wheel which includes, integral with each other and with a wheel body, a pinion which is external to said at least one barrel and meshes with a drum toothing in said at least one barrel, and a plate meshing with a third wheel which meshes in turn with a main seconds arbor pivoting about said main pivot axis coaxially to said cannon-pinion and to said hour wheel in a center tube.

8. The timepiece gear train device according to claim 1, further comprising a small seconds wheel meshing with a pinion in a main seconds arbor pivoting about said main pivot axis coaxially to said cannon-pinion and to said hour wheel, in a center tube, via at least one intermediate wheel, said center tube being mounted in abutment, via a shoulder therein, on a bottom plate, on a side of a first surface which is a dial side surface.

9. The timepiece gear train device according to claim 8, wherein said small seconds wheel is mounted concentrically to a date driving wheel, which cooperates with an intermediate date wheel to drive a date disc.

10. The timepiece gear train device according to claim 1, wherein said at least one cannon-pinion and said hour wheel are coaxially mounted, axially guided on each other and on a center tube centered on said main pivot axis and secured to a bottom plate on a side of a first surface which is a dial side surface, and wherein said at least one cannon-pinion and said hour wheel are held axially by a retaining plate.

11. The timepiece gear train device according to claim 10, wherein said retaining plate forms or carries a complementary display dial which cooperates with one of said display means, hands, discs or, rings driven by said cannon-pinion and said hour wheel.

12. The timepiece gear train device according to claim 10, wherein said retaining plate includes elastic return means arranged to press wheel sets onto said bottom plate.

13. The timepiece gear train device according to claim 1, wherein said friction spring is a riveted flat spring.

14. The timepiece gear train device according to claim 1, wherein components of said gear train device which together form a going train of the device are mounted taut.

15. A timepiece movement comprising:

at least one of a timepiece gear train device according to claim 1, and a gear train module including the at least one timepiece gear train device having a bottom plate carrying wheel sets, said bottom plate including a first surface which is a dial side surface and a second surface which is a gear train side surface, said first and second surfaces being opposite to each other and connected by a peripheral edge, wherein said main pivot axis is located in proximity to a center of or at the center of said bottom plate, and the a diameter of said at least one barrel, which pivots about a barrel pivot axis substantially parallel to said main pivot axis and to said secondary pivot axis which are parallel to each other, covers an area about said barrel pivot axis, which is greater than the a smallest distance between said main pivot axis and said peripheral edge, wherein said gear train module further includes means of interface with an external means of adjusting said motion work, and wherein said timepiece movement further includes the external means of adjusting said motion work cooperating with interface means in said gear train module.

16. A timepiece movement comprising:

at least one of a timepiece gear train device according to claim 1, and a gear train module including the at least one timepiece gear train device having a bottom plate carrying wheel sets, said bottom plate including a first surface which is a dial side surface and a second surface which is a gear train side surface, said first and second surfaces being opposite to each other and connected by a peripheral edge, wherein said main pivot axis is located in proximity to a center of or at the center of said bottom plate, and the a diameter of said at least one barrel, which pivots about a barrel pivot axis substantially parallel to said main pivot axis and to said secondary pivot axis which are parallel to each other, covers an area about said barrel pivot axis, which is greater than the a smallest distance between said main pivot axis and said peripheral edge, wherein said gear train module further includes means of interface with an external means of powering said energy storage means including at least one barrel, and wherein said timepiece movement further comprises external means of adjusting said motion work cooperating with interface means in said timepiece gear train device.

17. A timepiece movement comprising:

at least one of a timepiece gear train device according to claim 1; and a gear train module including the at least one timepiece gear train device having a bottom plate carrying wheel sets, said bottom plate including a first surface which is a dial side surface and a second surface which is a gear train side surface, said first and second surfaces being opposite to each other and connected by a peripheral edge, wherein said main pivot axis is located in proximity to a center of or at the center of said bottom plate, and the a diameter of said at least one barrel, which pivots about a barrel pivot axis substantially parallel to said main pivot axis and to said secondary pivot axis which are parallel to each other, covers an area about said barrel pivot axis, which is greater than the a smallest distance between said main pivot axis and said peripheral edge, wherein said gear train module further includes means of interface with an external means of adjusting said motion work, and wherein said timepiece movement further includes an external means of powering said energy storage means including at least one barrel cooperating with said interface means in said gear train module.

18. The timepiece movement according to claim 17, wherein the timepiece movement is a watch, and wherein the at least one barrel has a diameter that is greater than half of a smallest dimension of said watch in a plane perpendicular to said main pivot axis.

19. A timepiece movement comprising:

at least one of a timepiece gear train device according to claim 1, and a gear train module including the at least one timepiece gear train device having a bottom plate carrying wheel sets, said bottom plate including a first surface which is a dial side surface and a second surface which is a gear train side surface, said first and second surfaces being opposite to each other and connected by a peripheral edge, wherein said main pivot axis is located in proximity to a center of or at the center of said bottom plate, and the a diameter of said at least one barrel, which pivots about a barrel pivot axis substantially parallel to said main pivot axis and to said secondary pivot axis which are parallel to each other, covers an area about said barrel pivot axis, which is greater than the a smallest distance between said main pivot axis and said peripheral edge, wherein said gear train module further includes means of interface with an external means of powering said energy storage means including at least one barrel, and wherein said timepiece movement further includes an external means of powering said energy storage means including at least one barrel cooperating with said interface means in said gear train module.

20. The timepiece movement according to claim 19, wherein the timepiece movement is a watch, and wherein the at least one barrel has a diameter that is greater than half of a smallest dimension of said watch in a plane perpendicular to said main pivot axis.

* * * * *